United States Patent [19]

Abe et al.

[11] Patent Number: 4,637,364

[45] Date of Patent: Jan. 20, 1987

[54] METHOD FOR CONTROLLING AIR-FUEL RATIO FOR INTERNAL COMBUSTION ENGINE AND APPARATUS THEREFOR

[75] Inventors: Shinichi Abe, Toyota; Toshiaki Mizuno, Nagoya, both of Japan

[73] Assignee: Toyota Jidosha Kabushiki Kaisha, Toyota, Japan

[21] Appl. No.: 768,925

[22] Filed: Aug. 23, 1985

Related U.S. Application Data

[63] Continuation of Ser. No. 597,096, Apr. 5, 1984, abandoned.

[30] Foreign Application Priority Data

Apr. 12, 1983 [JP] Japan ..... 58-64188

[51] Int. Cl.[4] ..... F02B 3/80

[52] U.S. Cl. ..... 123/492; 123/478

[58] Field of Search ..... 123/478, 492, 440, 438, 123/436

[56] References Cited

U.S. PATENT DOCUMENTS

| | | | |
|---|---|---|---|
| 3,789,816 | 2/1974 | Taplin et al. | 123/478 |
| 4,112,879 | 9/1978 | Assenheimer et al. | 123/478 |
| 4,245,605 | 1/1981 | Rice et al. | 123/478 |
| 4,359,991 | 11/1982 | Stumpp et al. | 123/478 |
| 4,385,596 | 5/1983 | Hosaka | 123/492 |
| 4,411,236 | 10/1983 | Matsui et al. | 123/492 |
| 4,413,602 | 11/1983 | Inoue et al. | 123/492 |
| 4,418,673 | 12/1983 | Tominari et al. | 123/478 |
| 4,437,446 | 3/1984 | Isomura et al. | 123/492 |
| 4,440,136 | 4/1984 | Danz et al. | 123/492 |
| 4,480,620 | 11/1984 | Tange et al. | 123/478 |
| 4,492,202 | 1/1985 | Muramadru et al. | 123/478 |

*Primary Examiner*—Raymond A. Nelli

*Attorney, Agent, or Firm*—Cushman, Darby & Cushman

[57] ABSTRACT

Disclosed is a method of controlling the air-fuel ratio of an air-fuel mixture to be supplied to an internal combustion engine by the selective use of either one of a feedback control mode in which the control is made to maintain the air-fuel ratio at the stoichiometric level and a lean control mode in which the control is made to maintain at the leaner side of the stoichiometric level in accordance with the state of operation of the engine. In this method, the execution of the control in the lean control mode is prohibited for a predetermined period of time during acceleration of the engine at least when the speed of vehicle mounting the engine is below a predetermined speed, and the air-fuel ratio control is made in the feedback control mode in the period of time. Consequently, the period of engine operation in the lean control mode is maximized without impairing the driveability of the engine particularly when the engine is accelerated from low speed. Disclosed also is an apparatus suitable for carrying out this method.

10 Claims, 15 Drawing Figures

40
20
0
VEHICLE SPEED
SPD (Km/h)
t0
t1
t2
t3
t4
TIME t

IDLE SIGNAL S2
ON
OFF 5
0
CONTENT OF COUNTER CLL

AIR-FUEL RATIO CONTROL
FEEDBACK CONTROL OR LEAN CONTROL
FUEL CUT-OFF OR IDLE LEAN CONTROL
FEEDBACK CONTROL
FEEDBACK CONTROL OR LEAN CONTROL

METHOD FOR CONTROLLING AIR-FUEL RATIO FOR INTERNAL COMBUSTION ENGINE AND APPARATUS THEREFOR

This is a continuation of application Ser. No. 597,096, filed Apr. 5, 1984, which was abandoned upon the filing hereof.

BACKGROUND OF THE INVENTION

The present invention relates to a method of and apparatus for controlling the air-fuel ratio of an air-fuel mixture which is to be supplied to an internal combustion engine. More particularly, the invention is concerned with an air-fuel ratio controlling method and apparatus in which the mode of air-fuel ratio control is switched selectively in accordance with the state of the engine operation between a feedback control mode in which the air-fuel ratio is controlled in conformity with the stoichiometric one and a feed-forward control mode referred to as "lean control" in which the control is made to maintain an air-fuel ratio greater than the stoichiometric value, i.e. to maintain a mixture leaner than the stoichiometric one.

Generally, in automotive engines equipped with an exhaust scrubber using a ternary catalyst type, it is necessary to effect the air-fuel ratio control such that the air-fuel ratio, which is directly related to the condition of combustion in the enigne, is always maintained around the stoichiometric level, in order to keep the exhaust emissions clean.

To cope with this demand, a feedback control method has been proposed and used in which the oxygen content in the exhaust gases is detected by an $O_2$ sensor as an index of the air-fuel ratio of the mixture, and the air-fuel ratio control is conducted in accordance with the output from the $O_2$ sensor such that the air-fuel ratio coincides with the stoichiometric ratio.

When the engine is operating under comparatively light load, it is possible to decrease the rate of fuel consumption by maintaining the air-fuel ratio at the leaner side of the stoichiometric value without being accompanied by substantial degradation of the exhaust emissions because, under the light load, the rate of generation of nitrogen oxide is sufficiently small. Under these circumstances, an automotive engine has been proposed in which the control operation mode is selectively switched between the feedback control mode for maintaining the air-fuel ratio at the stoichiometric level and the lean control mode for maintaining the mixture at the leaner side of the stoichiometric one through a feed-forward control, thereby to keep the exhaust emissions clean while minimizing the fuel consumption.

In the system for controlling the air-fuel ratio, several conditions of the engine are detected to discriminate whether a condition for lean control mode is met or not, which include at least a cooling water temperature being higher than a reference temperature, an engine load being less than a reference load and vehicle speed being higher than a first reference speed. The fulfillment of the condition for lean control mode causes the engine to be operated under the lean air-fuel ratio. However, if the engine is required to be slightly accelerated while the condition for the lean control mode is fulfilled, the performance of the engine may not fully meet with the driver's desire due to the lean air-fuel ratio. Such an undesirable performance of the engine that the required slight acceleration is not effected has been experienced in the conventional lean control apparatus especially when a throttle valve being fully closed so as to cause the engine to be decelerated is gradually opened.

The selective use of the feedback control mode and the lean control mode, however, imposes the following problems particularly when the engine is used in heavy vehicles such as automobiles having weight of 1.25 tons or more or in vehicles having automatic transmissions.

When the vehicle, which is running at a constant speed of less than 25 Km/h for example, is to be accelerated gently, or when the vehicle is to be accelerated gently after deceleration with full closing of the throttle valve, the conditions for the lean control mode may be fully met. At this time, the lean control is executed, so that the driveability is impaired due to insufficient output torque of the engine.

In such a case, it would be possible to dismiss the lean control by kicking down the accelerator pedal, thereby to switch the control mode to the feedback control mode to obtain the large output torque. This, however, is not preferred because the kick down of the accelerator pedal causes an impractically large fuel consumption.

In some automotive engines, the conditions for execution or dismissal of the lean control include the degree of acceleration of the engine detected through calculation of the variance of the engine speed or vehicle speed at a period of one to several seconds, rather than through the detection of variance of the opening degree of the intake throttle valve or the variance of the intake pressure. In such engines, there is a fear that the air-fuel ratio control is made in the lean control mode for at least one to several seconds even when there is a demand for a acceleration including a comparatively quick acceleration during running at low speed. Consequently, the driver faces the same problem as described above.

SUMMARY OF THE INVENTION

Accordingly, an object of the invention is to provide a method of controlling the air-fuel ratio of the mixture to be fed to an internal combustion engine, in which either one of the lean control mode and the feedback control mode is used selectively in accordance with the state of engine operation, such that the period of the engine operation in the lean control mode is maximized without imparing the driveability during low-speed running of the vehicle and without increasing the fuel consumption rate unnecessarily.

Another object of the invention is to provide an apparatus for controlling the air-fuel ratio of the mixture to be fed to an internal combustion engine, in which either one of the lean control mode and the feedback control mode is used selectively in accordance with the state of engine operation, such that the period of the engine operation in the lean control mode is maximized without impairing the driveability during low-speed running of the vehicle and without increasing the fuel consumption rate unnecessarily.

In the present invention, when the engine is accelerated while the vehicle speed is below a predetermined speed, the lean control is prohibited for a predetermined time duration and, insteadly, the air-fuel ratio control is made at least in the feedback control mode when a condition for the feedback control is fulfilled.

Also in the present invention, when the engine is accelerated immediately after the deceleration while the vehicle speed is below a predetermined speed, the lean control is prohibited for a predetermined time duration and, insteadly, the air-fuel ratio control is made at least in the feedback control mode when a condition for the feedback control is fulfilled.

Therefore, according to the invention, it is possible to obtain, in the operation of an internal combustion engine which is adapted to selectively use one of the lean control and the feedback control modes, the desired acceleration performance while making the maximum use of the lean control to achieve a fuel economy, when the vehicle is accelerated by a gentle depression of the acceleration pedal during running of the vehicle at a low speed of less than 25 Km/h, for example, or when the engine is accelerated by depression of the accelerator pedal immediately after the release of the pedal for deceleration of vehicle to a speed less than 25 Km/h, for example.

These and other objects, features and advantages of the invention will become clear from the following description of the preferred embodiment taken in conjunction with the accompanying drawings.

BRIEF DESCRIPTION OF THE DRAWINGS

FIGS. 8,8*a* and 8*b* are flow charts showing an example of the process for computing lean correction factor coefficient FLEAN;

FIG. 1OB is a waveform chart showing an example of the idle signal S2;

FIG. 1OC is a time chart showing the content of a counter CLL; and

FIG. 1OD is a diagram showing the state of the air-fuel ratio control.

DESCRIPTION OF THE PREFERRED EMBODIMENTS

Figure 1:
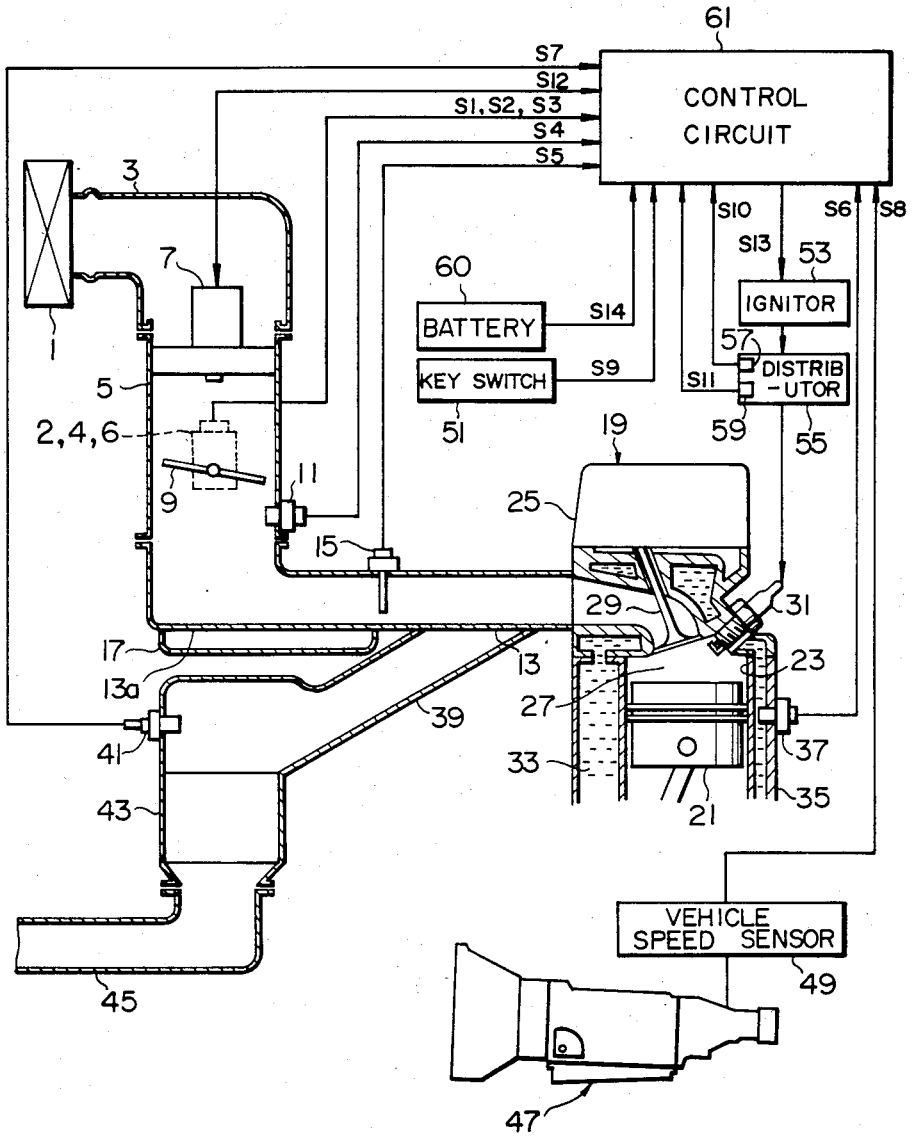
FIG. 1 is a schematic block diagram of an automotive internal combustion ehgine to which the present invention is applied.

FIG. 1 shows an example of an automotive internal combustion engine having an electronic fuel injection system to which the invention is applied. An air filter 1 is connected to a throttle body 5 through an inlet pipe 3. The throttle body 5 is provided at its upstream side with a fuel injector 7. An throttle valve 9 disposed at the downstream side of the fuel injector 7 is operatively connected to an accelerator pedal (not shown) so as to control the intake air flow rate in accordance with the position of the accelerator pedal (not shown). An absolute intake pressure sensor 11 disposed at the downstream side of the throttle valve 9 is adapted to sense the absolute pressure of the intake air at that portion. The throttle valve 9 is associated with various other parts such as the valve open position sensor 2 for measuring the opening degree of the throttle valve 9, an idle switch 4 which takes on position only when the throttle valve 9 is fully or substantially fully closed, and a power switch 6 which is kept in on state when the opening degree of the throttle valve 9 exceeds a predetermined value such as, for example, 40° C.

The throttle body 5 is connected to an intake manifold 13 having branch pipes leading to respective cylinders of the engine. The intake manifold 13 is provided with an intake air temperature sensor 15 adapted to sense the temperature of the intake air in the intake manifold 13. The intake manifold 13 is provided on the bottom wall 13*a* thereof at the upstream side of the branching point with a riser portion 17 through which the heated cooling water is circulated to heat the air-fuel mixture through the wall of the intake manifold.

A reference numeral 19 designates the body of the engine known per se. The engine is provided with a plurality of clinders 23, pistons 21 and cylinder heads 25 which in combination define combustion chambers 27 (only one of them is shown). Each clinder is provided with an intake valve 29 through which the air-fuel mixture is introduced into the combustion chamber 27. The mixture is then ignited by a ignition plug 31. During the operation, the cylinder 23 and other associated parts are cooled by cooling water which is circulated through a water jacket 33 formed around the cylinder 23. The temperature of the cooling water in the water jacket 33 is sensed by a cooling water temperature sensor 37 attached to the outer wall of the cylinder block 35.

Branch pipes of an exhaust manifold 39 are connected to the exhaust ports (not shown) formed in the cylinder heads 25 of respective cylinders 23. The exhaust manifold 39 is provided at its downstream end portion with $O_2$ sensor 41 adapted to sense the residual oxygen content in te exhaust gas. The exhaust manifold 39 is connected to an exhaust pipe 45 through a ternary catalyst 43.

The speed of the automobile is sensed by a vehicle speed sensor 49 which is attached to the final output shaft of a transmission 47 coupled to the body 19 of the engine. Reference numerals 51, 53 and 55 denote, respectively, a key switch, igniter and a distributer. The distributor 55 is provided with an Ne sensor 57 adapted to produce an on-off signal for each angle $\theta$ 1 of the crank rotation. It is possible to detect the engine speed and desired angular position of the crank from the output of the Ne sensor 57. A G sensor 59 which also is provided in the distributor 55 produces an on-off signal for each angle of $\theta$ 2 of crank rotation greater than the above-mentioned angle $\theta$ 1. The discrimination or identification of the cylinders and detection of the top dead centers are made by processing the output signal from the G sensor 59. A reference numeral 60 designates a battery.

A control circuit 61 is connected to various sensors such as the valve position sensor 2, idle switch 4, power switch 6, intake pressure sensor 11, intake air temperature sensor 15, cooling water temperature sensor 37, $O_2$ sensor 41, vehicle speed sensor 49, key switch 51, Ne sensor 57, G sensor 59 and the battery 60. Thus, the control circuit 61 receives from these sensors various signals such as a throttle valve opening degree signal Sl, idle signal S2, power signal S3, intake pressure signal S4, intake air temperature signal S5, water temperature signal S6, air-fuel ratio signal S7, vehicle speed signal S8, start signal S9, engine speed signal SlO, cylinder identification signal Sll and the battery voltage signal S14.

The control circuit 61 is connected also to the fuel injector 7 and the igniter 53 so that it can produce a fuel injection signal S12 and a ignition signal S13.

Figure 2:
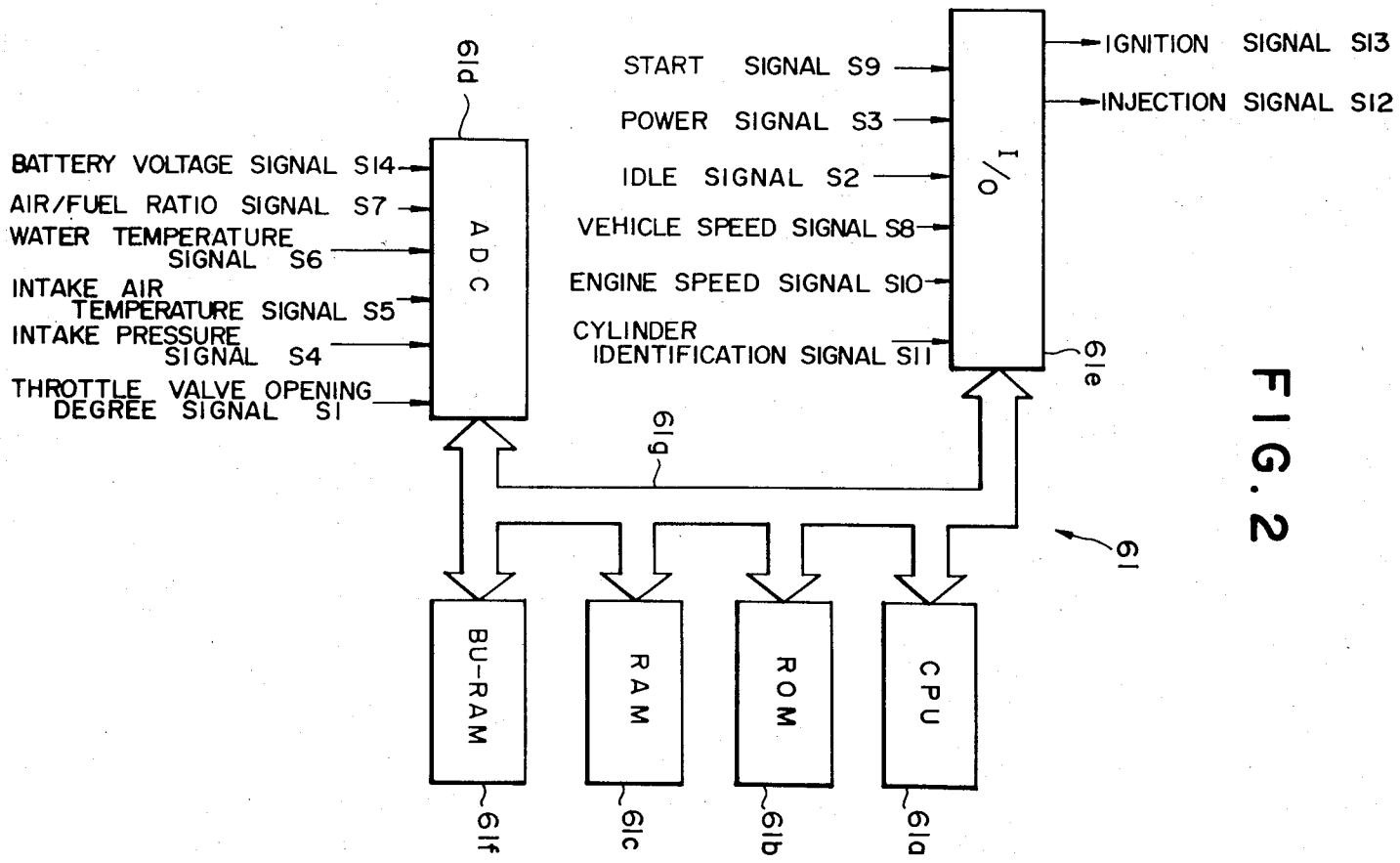
FIG. 2 is a detailed block diagram showing an example of the control circuit incorporated by the engine shown in FIG. 1.

As shown in FIG. 2, the control circuit 61 has the following parts or constituents: a central processing unit (CPU) 61*a* for controlling various devices; read only memory (ROM) 61*b* in which written are various numerical values and programs; a random access memory (RAM) 61*c* having regions in which written are. numerical values obtained in the course of computation, as well as flags; an A/D converter (ADC) 61*d* for converting analog input signal into digital signals; an input/output interface (I/O) 61*e* through which various digital signals are inputted into and outputted from the control circuit; a backup memory (BU-RAM) 61*f* adapted to be supplied with electric power from an auxiliary power source when the engine is not operating thereby to hold the contents of the memory; and a BUS line 61*g* through which these constituents are connected to one another. Programs which will be detailed later are written in the ROM 61*b*.

Figure 3:
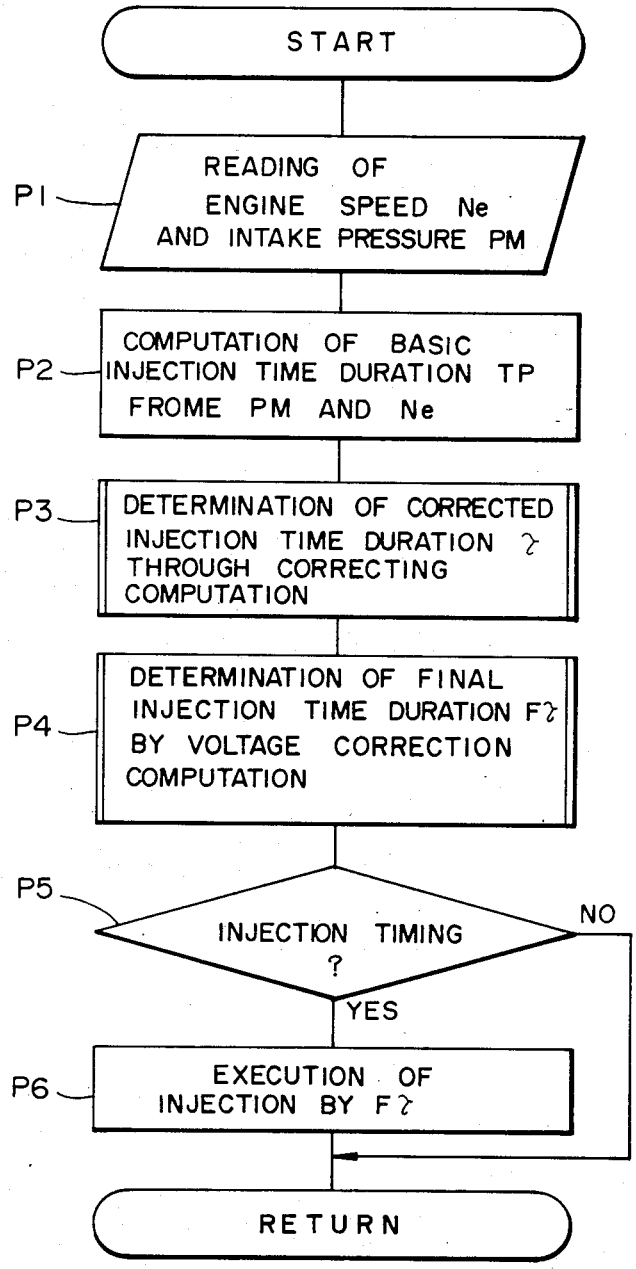
FIG. 3 is a flow chart showing an example of fuel injection process.
Figure 4:
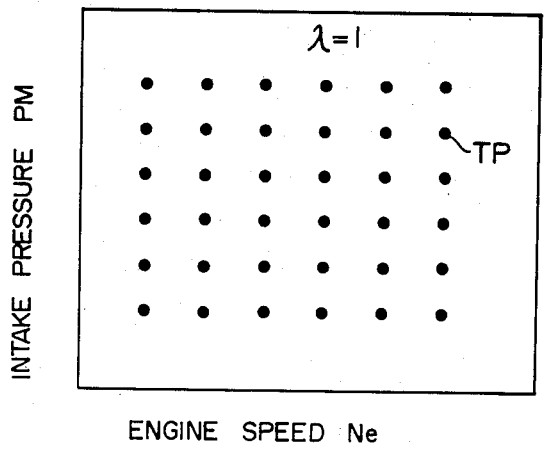
FIG. 4 is a diagram showing a map for determining the basic fuel injection time duration TP with parameters of the engine speed Ne and the intake pressure PM.

In the operation of the engine described above, fuel is injected in accordance with the flow chart shown in FIG. 3. More specifically, in a step P1, the engine speed Ne is read in the form of the engine speed signal S1 which is the reference position signal. At the same time, the intake pressure PM is read in the form of an intake pressure signal S4. In a step P2, the basic injection time duration TP is read from the map shown in FIG. 4 using the read values of the engine speed Ne and the intake pressure PM. In a step P3, a corrected injection time duration $\tau$ is determined through a computation which is conducted in accordance with the operating condition of the engine.

A detailed description will be made hereinunder as to the process for computing the corrected injection time duration $\tau$ in the step P3.

The injection time duration $\tau$ is generally obtainable from the folowing formula.

$$\tau = TP \times FWL \times FAF \times FTHA \times (FTC + FPO + FSE + FLEAN) \quad (1)$$

where,

TP represents the basic fuel injection time duration, FWL represents the warm-up incremental coefficient, FAF represents the air-fuel ratio feedback coefficient, FTC represents the transient-period air-fuel ratio correction coefficient, FTHA represents the intake air temperature correction coefficient, ESE represents the post-start incremental coefficient, FPO represents the power incremental coefficient and FLEAN represents the lean correction coefficient.

Figure 5:
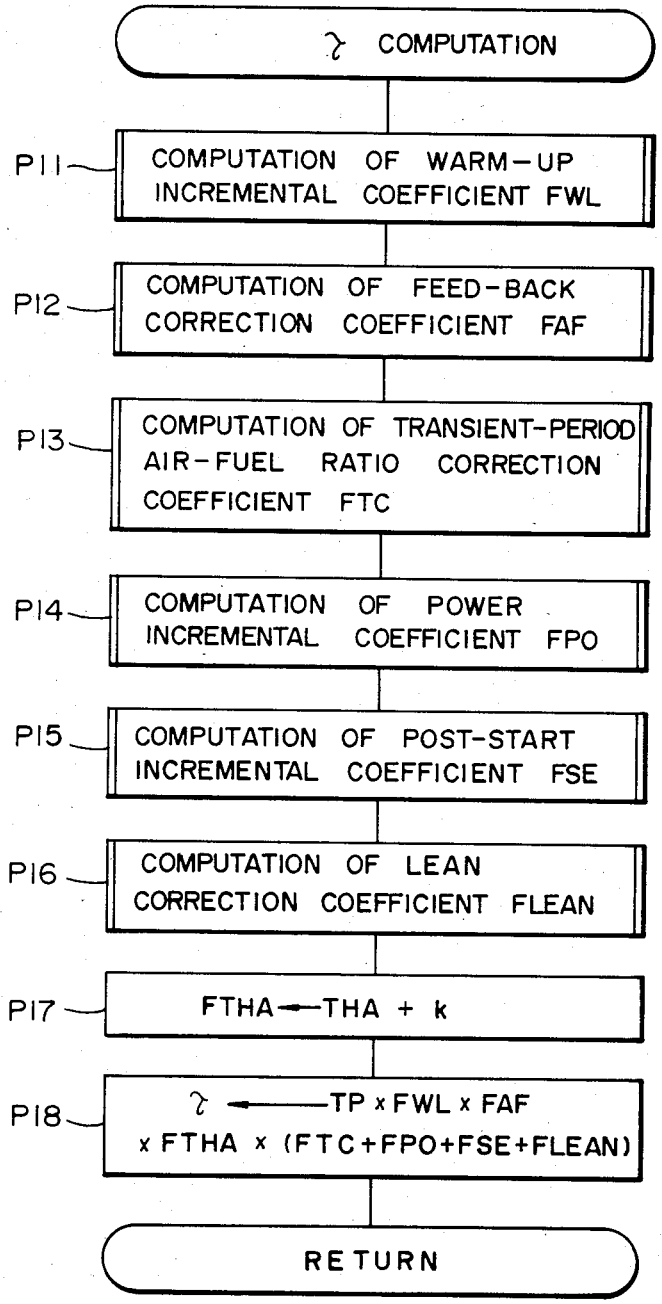
FIG. 5 is a flow chart showing an example of the process for determining corrected fuel injection time duration $\tau$.

These coefficients are calculated in accordance with the operation routine shown in FIG. 5 and the injection time duration $\tau$ is determined using these coefficients. Namely, in a step P11, a calculation is made to determine the warm-up incremetal coefficient FWL, whereas, in a step P12, a calculation is made to determine the air-fuel ratio feedback correction coefficient FAF. In the next step P13, a calculation is made to determine the air-fuel ratio correction coefficient FTC in the transient period. Subsequently, a calculation is made to determine the power incremental coefficient FPO in a step P14. Then, in a step P15, a calculation is made to determine the post-start incremental coefficient FSE. In the next step P16, the lean correction coefficient FLEAN is calculated and the intake air temperature correction coefficient FTHA is calculated in a next step P17. Finally, the computation is conducted in a step P18 in accordance with the formula (1) above, and the process is returned to the step P4 of the routine shown in FIG. 3.

In the step P4, the corrected injection time duration $\tau$ is further corrected in accordance with the battery voltage, thereby to determine the final injection time duration $F\tau$. If a judgement in a step P5 proves that the present instant is within the injection timing, fuel is injected from the injector for a time duration corresponding to the final injection time $F\tau$ in a step P6.

A description will be made hereinunder as to the computing operation in each of the steps P11 to P18.

The computation in the step P12 for determining the feedback correction coefficient FAF is conducted in a manner explained hereinunder.

Figure 6:
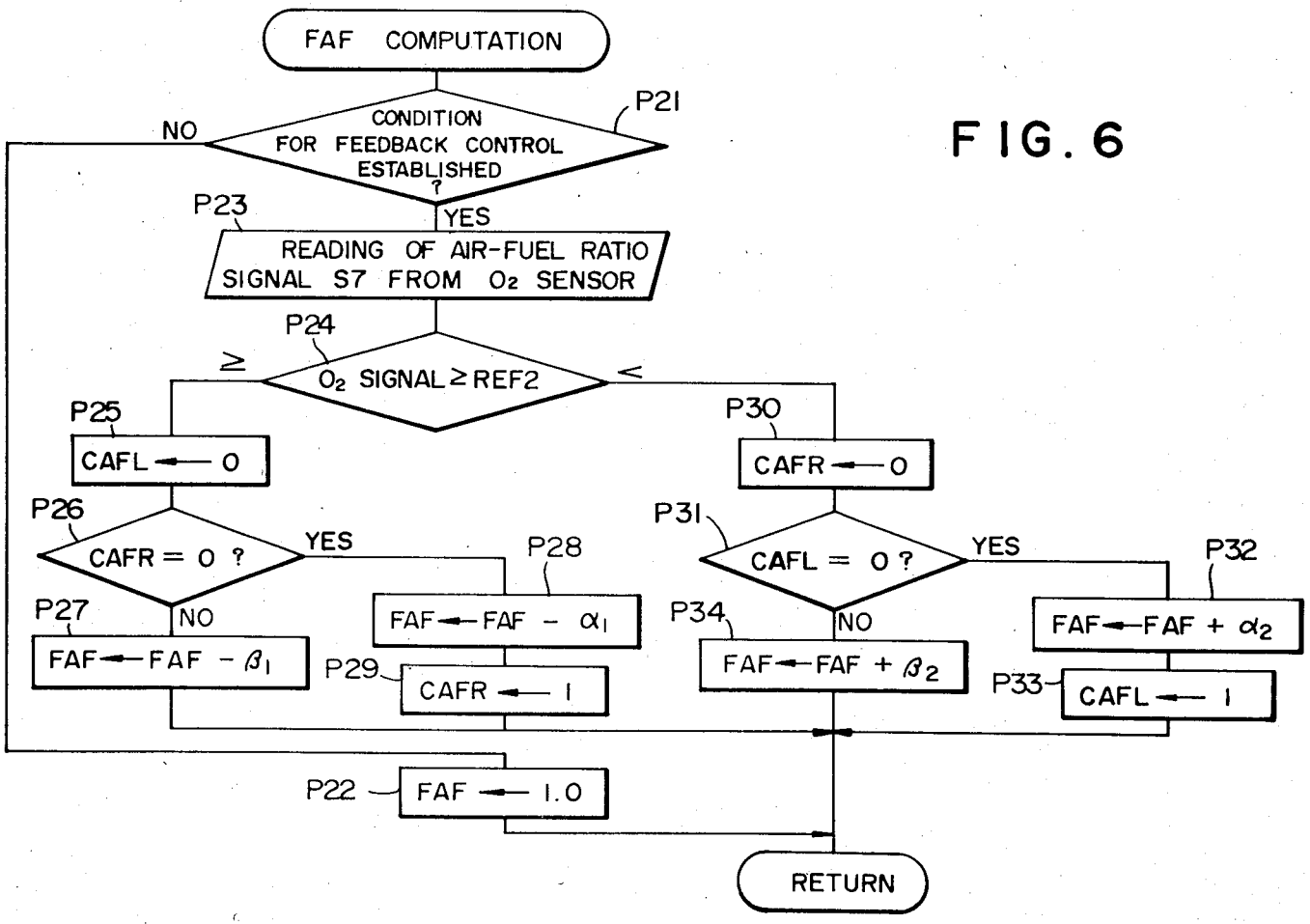
FIG. 6 is a flow chart showing an example of the process for computing feedback correction factor coefficient FAF.

An example of process for computing the feedback correction coefficient FAF is shown in FIG. 6. As the routine for computing the air-fuel ratio feedback correction coefficient FAF is started, a judgement is made in a step P21 to judge whether the feedback condition has been established. The condition for the feedback is eatablished when all of the following requirements are met: engine is not being stated; post-start incremental coefficient FES is zero; cooling temperature is not lower than 40° C.; and power incremental cofficient FPO is zero. If the condition for the feedback has not been established, the feedback correction coefficient FAF is set at 1.0 in the step P22 to prohibit the feedback control thereby to complete this process. On the other hand, if the condition for the feedback has been established, the process proceeds to a step P23.

The air-fuel ratio signal S7 is read in the step P23. In a step P24, the voltage value of this air-fuel ratio signal S7 is compared with a reference value REF2. When the level of the signal S7 exceeds the reference value REF2, it is judged that the air-fuel ratio is too small, i.e. the mixture is too rich, and the process is started to increase the air-fuel ratio, i.e. to make the mixture more lean.

Namely, after setting the flag CAFL at zero in a step P25, the process proceeds to a step P26 in which a judgement is made as to whether the state of the flag CAFR is zero. If the process has been shifted to too rich side for the first time, the state of the flag CAFR is zero, so that the process proceeds to a step P28 in which a predetermined value $\alpha 1$ is subtracted from the correction coefficient FAF stored in the RAM 61C and the result of this calculation is used as new correction coefficient FAF.

In the step P29, the flag CAFR is set to be 1. Therefore, if the air-fuel mixture is judged to be too rich in successive two judging cycles in the step P24, negative judgement is made without fail in the step P26 in the second and the following judging cycles, so that the process proceeds to a step P27 in which a predetermined value $\beta 1$ is subtracted from the correction coefficient FAF. The result of this calculation is then determined as the new correction coefficient FAF, thus completing the FAF operation.

On the other hand, if the judgement in the step P24 proves the level of the signal S7 to be smaller than the reference value REF2, it is judged that the air-fuel ratio is too large, i.e. the mixture is too lean, so that a process is taken to decrease the air-fuel ratio, i.e. to make the mixture richer.

More specifically, the process proceeds to a step P31 after setting the flag CAFR at zero in a step P30. In the step P31, a judgement is made as to whether state of the flag CAFL is zero or not. If the process has been shifted to the too lean side for the first time, the process proceeds to a step P32 because the state of the flag CAFL is zero. In the step P32, a predetermined value $\alpha 2$ is added to the correction coefficient FAF and the result of this addition is used as the new FAF. In a step P33, the state of the flag CAFL is set to be 1. Therefore, if the mixture is judged to be too lean in two successive judging cycles in the step P34, a negative judgement is made without fail in the second and the following judging cycles in the step P31. Then, the process proceeds to a step P34 in which a predetermined value $\beta 2$ is added to the correction coefficient FAF and the result of this addition is determined as the new FAF, thus completing the FAF operation. The values $\alpha 1$, $\alpha 2$, $\beta 1$ and $\beta 2$ used in the steps P27, P28, P32 and P34 are the values which have been determined beforehand.

Figure 7:
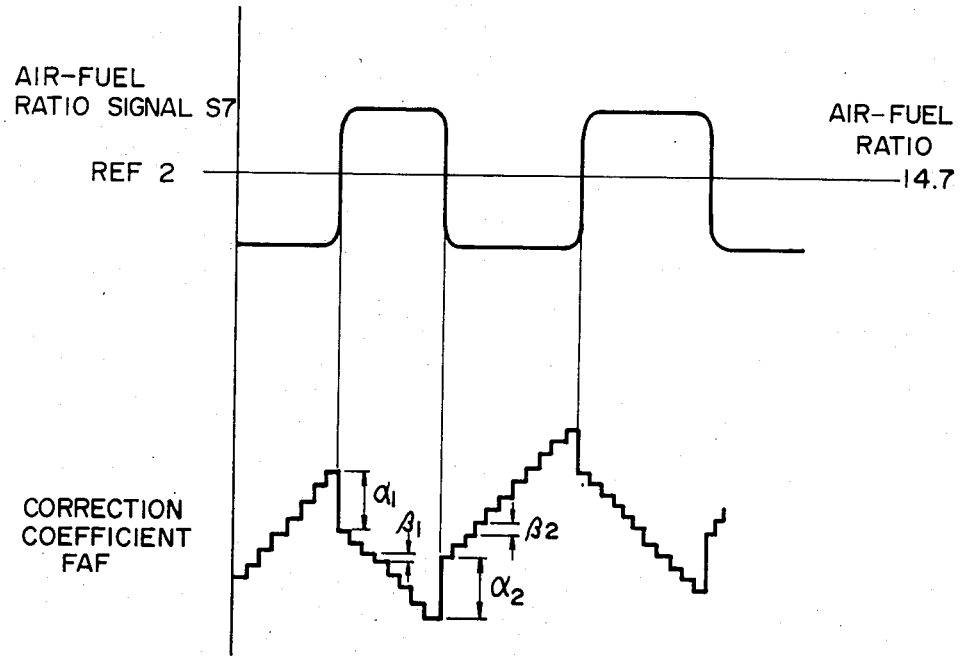
FIG. 7 is a time chart showing the relationship between the air-fuel ratio signal S7 and the feedback correction factor coefficient FAF.

The feedback correction coefficient FAF determined through this operation is shown in FIG. 7 together with the air-fuel ratio signal S7. The following will be noted from this Figure. Namely, when the signal S7 rises above the reference value REF2 or drps below the same, the correction coefficeint FAF is skipped by an amount $\alpha 1$ or $\alpha 2$. Thereafter, when the signal S7 exceeds the reference value, the predetermined value $\beta 1$ is subtracted successively, whereas, if the signal S7 is below the reference value, the predetermined value $\beta 2$ is added successively.

A description will be made hereinunder as to the computation of the lean correction coefficient FLEAN conducted in a step P16, with specific reference to FIG. 8.

Figure 8A:
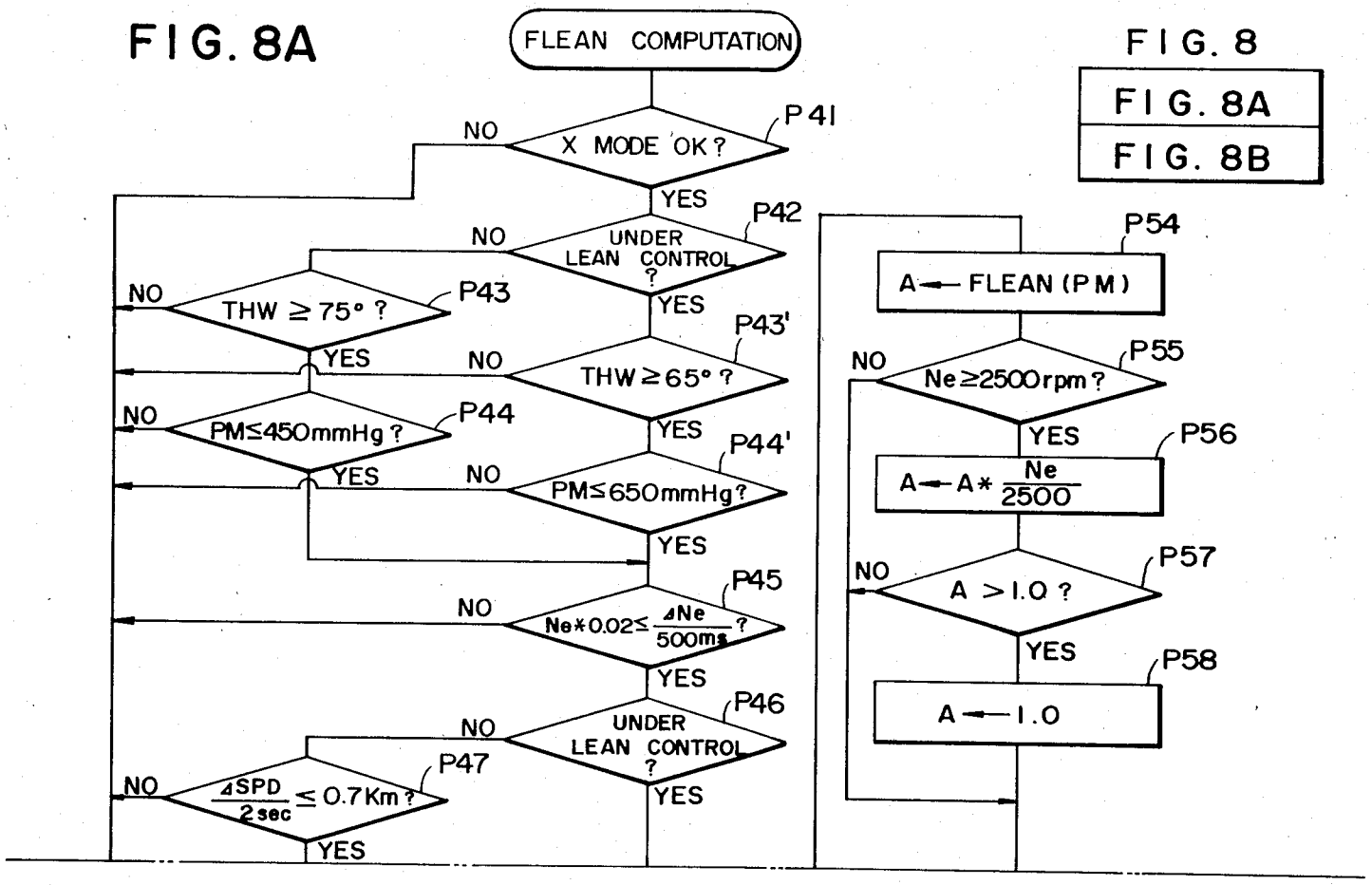
Figure 8B:
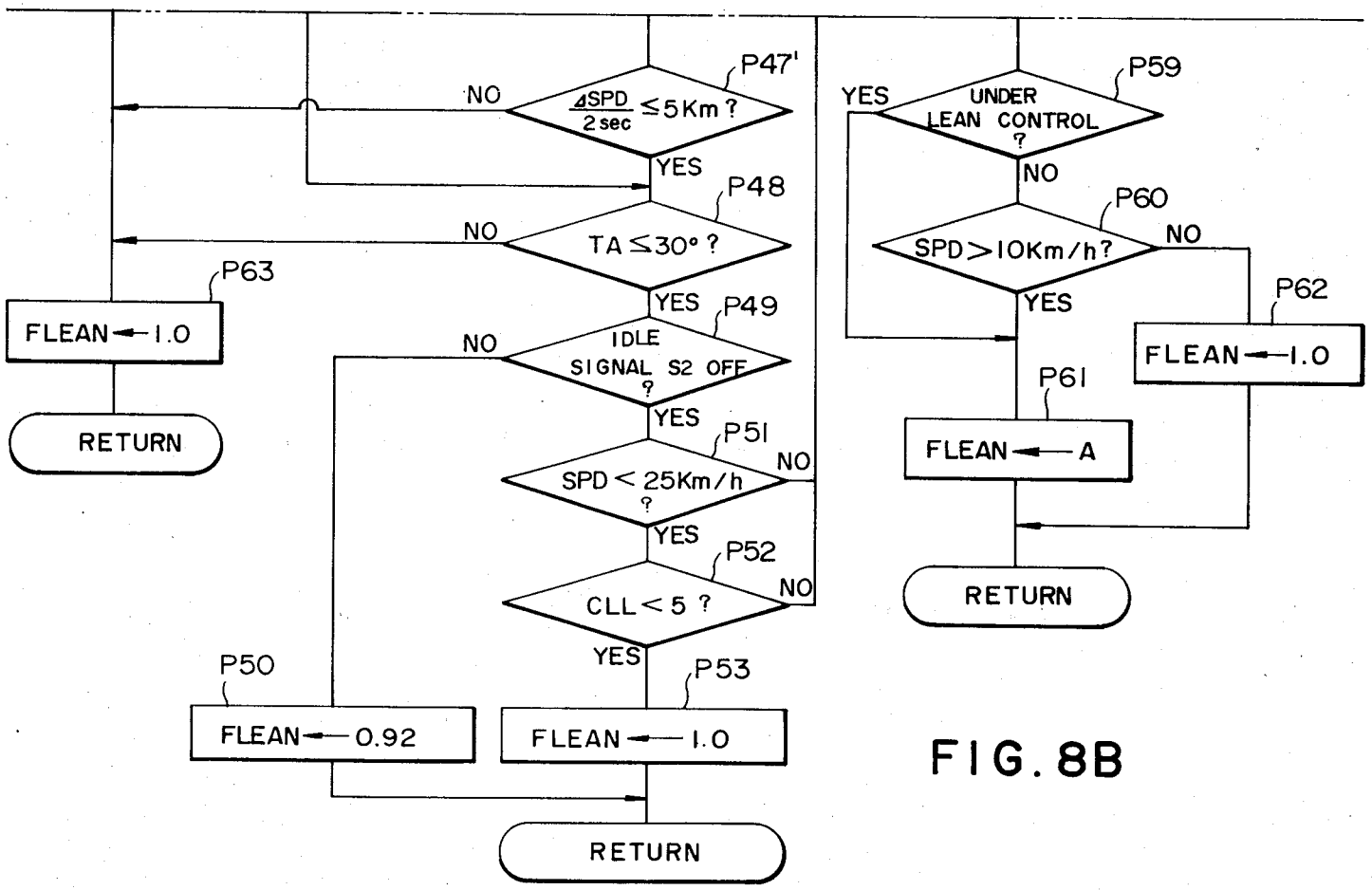

As a program as shown in FIG. 8 is started, a judgement is made in a step P41 as to whether the mode condition XMODE is satisfied. More specifically, this condition is satisfied when the engine is not being started up nor in the post-start fuel incremental phase nor in the power incremental phase. The judgement as to whether the engine is not being started up is made in accordance with the start signal S9 and the engine speed signal SlO. The judgement concerning the post-start fuel incremental phase after the starting is made on the basis of post-start fuel incremental coefficient FSE stored in a predetermined memory area. The judgement in regard to the power incremntal phase is made through judgement of the power incremental coefficient FPO stored in a predetermined memory area. If this condition is met, a judgement is made in a step P42 as to whether the engine is operating in the lean control mode. This judgement is made by discriminating the state of the lean correction coefficient FLEAN stored in the predetermined area of the RAM, i.e. whether the coefficient FLEAN is 1.0 or not. If the coefficient FLEAN IS 1.0, it is judged that the engine is operating in the feedback control mode for maintaining the mixture at the stoichiometric level of air-fuel ratio rather than in the lean control mode.

When the judgement in the step P42 proved that the engine is operating in the feedback control mode, the process can proceed to a step P45 for executing the lean control, provided that the cooling water temperature THW is judged to be 75° C. or higher in a step P43 and that the intake pressure PM is judged to be 450 mmHg or lower in a step P44.

If the judgement in the step P42 proves that the engine is operating in the lean control mode, the process proceeds to a step P43' in which a judgement is made as to whether or not the cooling water temperature is 65° C. or higher. If the answer is affirmative, the process proceeds to the next step P44' in which a judgement is made as to whether or not the intake pressure PM is 650 mmHg or lower. If yes, i.e. if the engine is operating under a light or medium load, the process proceeds to the next step P45.

In the step P45, a judgement is made as to whether or not $\Delta$Ne/500ms representative of a rate of change in the engine speed Ne is within 2% of the engine speed. If the answer is affirmative, a judgement is made in a step P46 as to whether the engine is in the lean control mode, in the same manner as that in the step P42 mentioned before. If the engine is not in the lean control mode, the process proceeds to a step P47 in which a judgement is made as to whether SPD/2sec representative of a rate of change of the vehicle speed SPD is a first judging level of, for example, 0.7 Km or less. However, if the engine is operating in the lean control mode, a judgement is made in a step P47' as to whether the rate SPD/2sec of vehicle speed SPD is a second judging level of, for example, 5 Km/sec or less.

In this embodiment, the use of different judging levels in the steps P43, P43', P44, P44', P47 and P47' is intended for elimination of hunting.

If an affirmative answer is obtained in the step P47 or P47', the process proceeds to a step P48 in which a judgement is made as to whether the opening degree of the throttle valve 9 is a predetermined judging level which is, for example, 30° C. or less. If the answer is affrimative, the proces proceeds to a step P49 in which a judgement is made as to whether the throttle valve 9 is fully closed or not, through discriminating whether the state of the idle signal S2 is on or off. When the idle signal S2 is in the on state, i.e. when the throttle valve 9 is fully closed, the process proceeds to a step P50 and the lean control is conducted after setting the lean correction coefficient FLEAN at 0.92.

On the other hand, if the throttle valve 9 is not fully closed, the process proceeds to a step P51 in which a judgement is made as to whether the vehicle speed SPD is below 25 Km/h, and further to a step P52 if the answer to this judgement is affirmative. In the step P52, it is judged whether the content of the counter CLL is below 5 or not. The counter CLL is adapted to be cleared in response to the leading edge of the idle signal S2 and is energized in response to the trailing edge of the same, and the content of this counter is increased in a stepped manner by "1" at every one second. If the content of the counter CLL is smaller than 5, the process proceeds to a step P53 in which the lean correction coefficient FLEAN is set at 1.0 thus completing this computing process. However, if a negative answer is obtained in the step P51 or P52, the process proceeds to a step P54.

Figure 9:
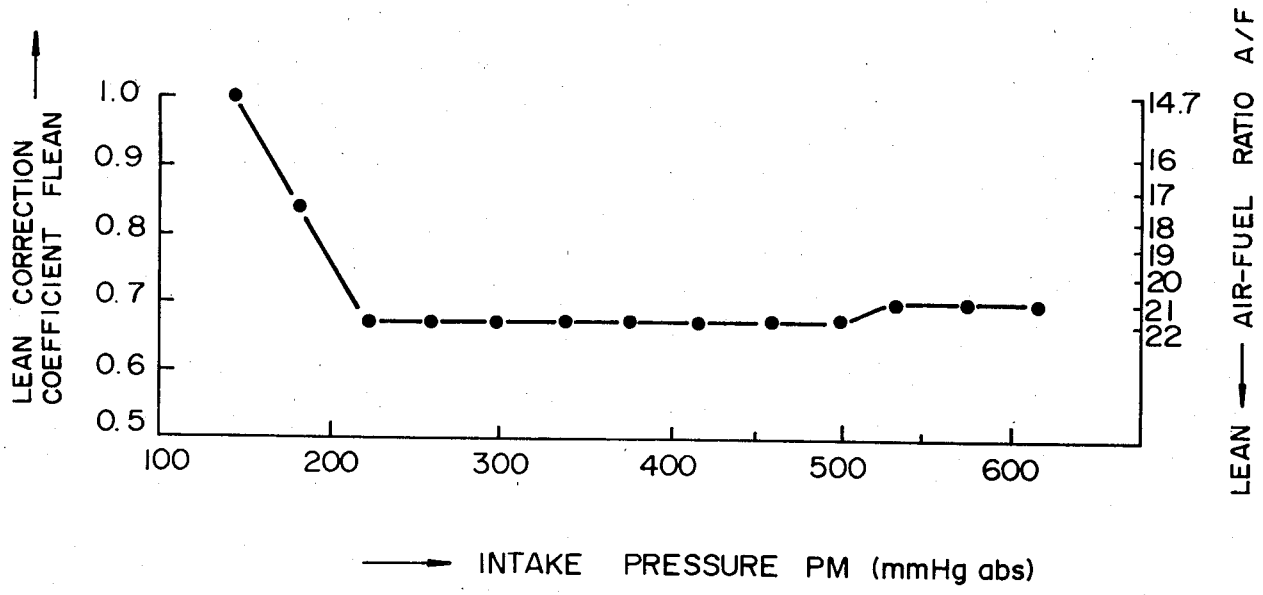
FIG. 9 is a graph showing the relationship between the intake presure PM and the lean correction coefficient FLEAN.

In the step P54, the lean correction coefficient FLEAN is determined from a map stored beforehand in the ROM 61*b*, using the read value of the intake pressure PM. As will be seen from FIG. 9, this map shows the relationship between the intake pressure PM and the lean correction coefficient FLEAN. The thus determined value of lean correction coefficient FLEAN is stored in the register A, and the process proceeds to a step P55.

In the step P55, a judgement is made as to whether the engine speed Ne is a predetermined speed which is, for example, 2500 rpmor higher.

If the answer is affirmative,i.e. when the engine is operating at a high speed, the content of the register A is multiplied in a step P56 by a coefficient which is given by Ne/2500 to shift the air-fuel ratio to the richer side, in order to avoid the occurrence of surgiung. Namely, in the step P56, FLEAN is increased to be (A ×Ne/2500).

In a step P57, a judgement is made as to whether the multiplied value newly stored in the register A is greater than 1.0. If so, the content of the register A is rewritten to be 1.0 in a step P58 and the process proceeds to a step P59. The step P59 is taken also when a negative answer is obtained in the step P55 or P57.

A judgement is made in the step P59 as to whether the engine is operating in the lean control mode, in the same manner as that described before in connection with the steps P42 and P46. When the engine is not in the lean control mode, i.e. when the engine is in the feedback control mode, a judgement is made in a step P60 as to whether the vehicle speed SPD exceeds a predetermined speed of, for example, 10 Km/h. If this predetermined speed is exceeded, the process proceeds to a step P61. However, if this speed is not exceeded, the process is finished after setting the lean correction coefficient FLEAN at 1.0 in a step P62 so as to prohibit the lean control.

On the other hand, when the judgement in the step P59 proves that the engine is operating in the lean control mode, the process proceeds to a step P61 skipping over the step P60.

In the step P61, the value of the lean correction coefficient FLEAN stored in the predetermined area in the RAM 61*c* is written with the content of the register A, thus completing this computing process.

If a negative answer is obtained in each of the steps P41, P43, P44, P43', P44', P45, P47, P47' and P48, the process proceeds to a step P63 in which the value of the lean correction coefficient FLEAN in the predetermined area of the RAM 61*c* is set at 1.0, thus finishing this computing process. In this case, the lean control is not conducted.

The warm-up incremental coefficient FWL computed in the step Pll shown in FIG. 5 is determined in accordance with, for example, the cooling water temperature THW and the engine speed Ne, such that the value of this coefficient FWL is increased as the cooling water temperature THW becomes lower and as the engine speed Ne becomes higher. This coefficient FWL is used in the incremental correction of the basic fuel injection time duration TP. The transient-period air-fuel ratio correction coefficient FTC computed in the step P13 is determined in accordance with, for example, the variance of the intake pressure calculated on the basis of the intake pressure signal S4 derived from the intake pressure sensor 11, such that the value of this coefficient FTC is increased as the variance of the intake pressure becomes greater. This coefficient FTC is used in the incremental correction of the basis fuel injection time duration TP.

The power incremental coefficient FPO mentioned in connection with the step P14 is predetermined as a value, for example, 1.5 when all of the following conditions are met: cooling water temperature THW higher than 20° C., engine speed Ne between 3500 and 4500 rpm, and throttle valve opening greater than 40° C. Otherwise, the coefficient FPO takes a value of 0 (zero).

The post-start incremental coefficient FSE mentioned in connection with the step P15 is determined by selecting an initial value in accordance with the cooling water temperature immediately after the start-up of the engine and then gradually attenuating the thus selected intial value. The intake air temperature correction coefficient FTHA is used for the purpose of compensation for the change in the density of the intake air according to the change in temperature. This coefficient is determined by adding a predetermined value "k" to the digital value of the intake air temperature THA.

The embodiment described hereinbefore will be further detailed hereinunder, with specific reference to FIGS. 10A to 10D.

Figures 10A, 10B, 10C, 10D:
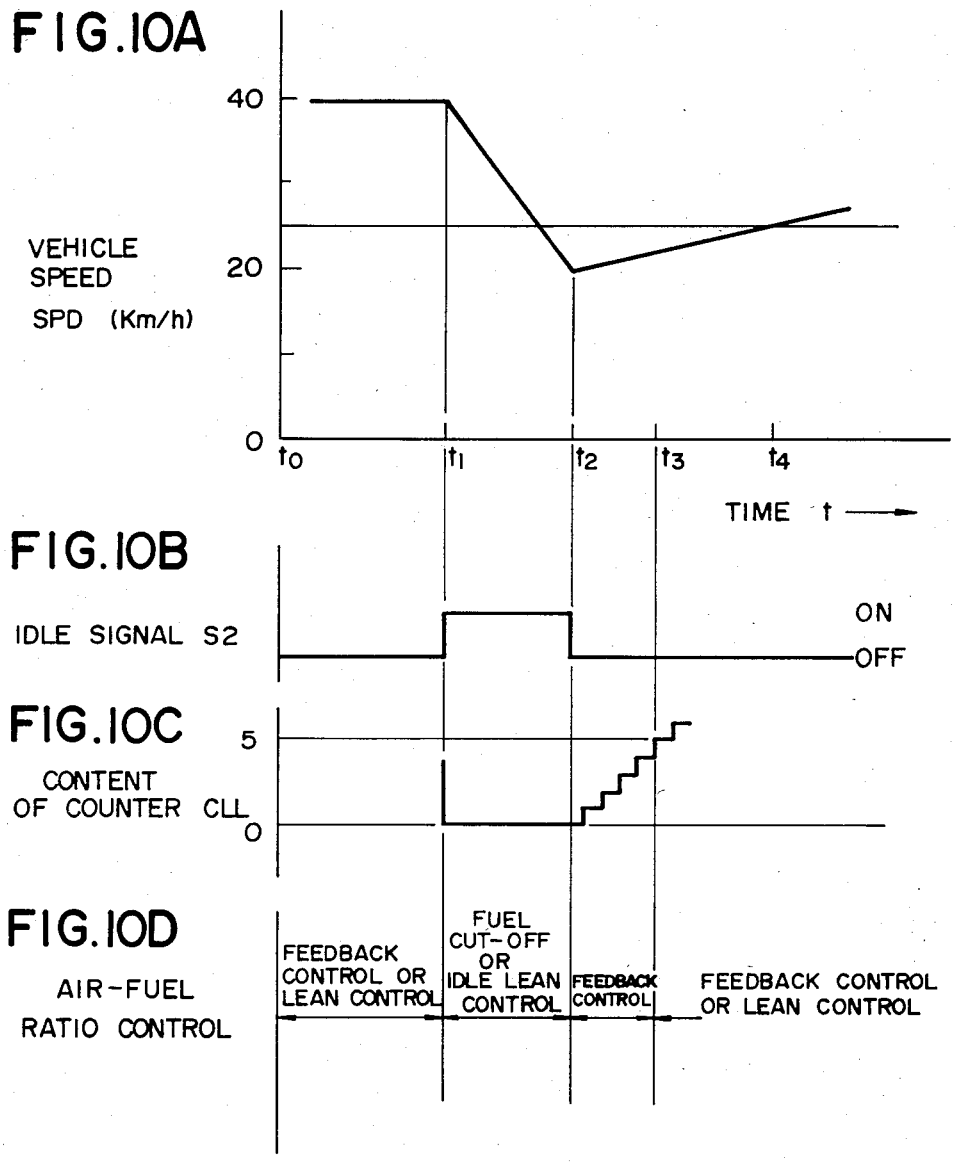
FIG. 10A is a graph showing an example of the change of the vehicle speed.

Referring first to FIG. 10A, as the accelerator pedal is released at a moment t1 to decelerate the engine, the vehicle speed SPD is decreased from the level of 40 Km/h and, at a moment t2 at which the vehicle speed comes down to 20 Km/h, the accelerator pedal is depressed again to gradually increase the vehicle speed. Referring now to FIG. 10B, the idle signal S2 is kept on only for the period between the moments t1 and t2. As will be seen from FIG. 10C, the counter CLL is cleared in response to the leading edge of the idle signal S2 and is energized in response to the trailing edge of the same, with its content increased in a stepped manner by "1" at every one second. In the judging step P52 of the flow shown in FIG. 8, the lean correction coefficient FLEAN is adapted to be kept at 1.0 until the content of the counter reaches "5", so that the feedback control is effected rather than the lean control provided that the conditions for the feedback control are met. Referring now to FIG. 10D, the air-fuel ratio is controlled either in the feedback control mode or the lean control mode, if the conditions for two control modes are satisfied, respectively, in the period between the time points to and tl. In the period between the time points tl and t2, the fuel supply to the engine is cut-off or a control in idle lean mode is conducted. In the period between the time points t2 and t3, the lean control is not executed and the feedback control is effected provided that conditions for this control mode are satisfied. In the period between the time points t3 and t4, the air-fuel ratio is controlled either in the feedback control mode or in the lean control mode, depending on which one of the conditions for these two modes is satisfied.

As has been described, in the embodiment described hereinbefore, the lean correction coefficient FLEAN is held at 1.0 for 5 seconds after the moment at which the throttle valve is started to open. In this period, therefore, at least the feedback control can be effected in the case of a fulfillment of condition for the feedback control. Accordingly the air fuel ratio A/F is maintained around the stoichiometric level. Further, in this period, if the condition for the feedback control is not fulfilled, the air fuel ratio A/F may be at the richer side of the stoichiometric level.

The described embodiment may be modified such that the lean correction coefficient FLEAN is set at 1.0 on condition that the vehicle speed is less than 25 Km/h, while the rate of change of vehicle speed in the last two seconds is below a predetermined value and the variance of intake pressure for every 12 ms is greater than a predetermined value. In this modification, it is possible to optimumly select one of the lean control mode and the feedback control mode, without imparing not only the acceleration immediately after the deceleration but also the acceleration after a normal running at low speed.

Needless to say, the described processes for the computation of the feedback control and the lean control are only illustrative and may be substituted by other processes, and the described processes for computing the fuel injection time duration are not exclusive.

It will be clear to those skilled in the art that the method of the invention can be applied not only to the internal combustion engines having fuel injectors but also to engines having electronic carburetors, while the apparatus of the invention can be used in various types of engines having fuel injectors.

What is claimed is:

1. A method of controlling the air fuel ratio of an air-fuel mixture to be supplied to an internal combustion engine comprising the steps of:

(a) detecting and determining that the engine is operating under a first operational state wherein conditions exist where a cooling water temperature is greater than a predetermined cooling water temperature, an engine load is less than a predetermined engine load and a vehicle speed is greater than a first operational condition of a predetermined vehicle speed;

(b) detecting said vehicle speed and determining if an additional first operational condition exists wherein said vehicle speed is less than a second predetermined vehicle speed wherein said second predetermined vehicle speed is greater than said first predetermined vehicle speed;

(c) detecting an engine acceleration and determining if a second additional operational condition exists wherein an acceleration of the engine is commencing; and (d) determining said air-fuel ratio such that when at least said first operational state exists, the air-fuel ratio is adjusted to the lean side of stroichiometric, and if both first and second additional operational conditions exist, the air-fuel ratio is adjusted towards substantially stoichiometric.

2. A method of controlling the air-fuel ratio of an air-fuel mixture according to claim 1 wherein the step of detecting an engine acceleration includes the steps of detecting an amplitude of an absolute intake pressure of an intake passage downstream of a throttle valve to calculate a variation of the absolute intake pressure between successive detected absolute intake pressures which in turn is compared with a reference value to determine whether said second additional operational condition exists wherein an acceleration of the engine is commencing.

3. A method of controlling the air fuel ratio of an air-fuel mixture to be supplied to an internal combustion engine comprising the steps of:

(a) detecting and determining that the engine is operating under a first operational state wherein conditions exist where a cooling water temperature is greater than a predetermined cooling water temperature, an engine load is less than a predetermined engine load and a vehicle speed is greater than a first operational condition of a predetermined vehicle speed;

(b) detecting said vehicle speed and determining if an additional first operational condition exists wherein said vehicle speed is less than a second predetermined vehicle speed wherein said second predetermined vehicle speed is greater than said first predetermined vehicle speed;

(c) measuring a time period starting from a time at which a fully closed throttle valve is opened;

(d) comparing the measured time period with a predetermined time period to determine whether the predetermined time period has lapsed;

(e) determining said air-fuel ratio such that when at least said first operational state exists, the air-fuel ratio is adjusted to the lean side of stoichiometric, and that if it is detected that the predetermined period of time has not lapsed and said additional first operational condition exists while the first operational state exists, the air-fuel ratio is adjusted towards substantially stoichiometric.

4. A method of controlling the air-fuel ratio of an air-fuel mixture to be supplied to an internal combustion engine according to claim 3 further comprising the steps of:

detecting a concentration of a predetermined component of an exhaust gas to generate an air-fuel ratio signal, wherein said engine is provided with a fuel injector and said step of determining the air-fuel ratio includes the steps of:

calculating a basic fuel injection time corresponding to a fuel injection rate of the fuel injector in accordance with an engine speed and the engine load;

correcting, depending on the engine operating state, the basic fuel injection time duration so that it becomes less than the basic fuel injection time duration, thereby attaining a lean air-fuel ratio leaner than the stoichiometric air-fuel ratio and wherein a result of correction is feedback controlled to be substantially at the stoichiometric air-fuel ratio.

5. A method of controlling the air-fuel ratio of an air-fuel mixture to be supplied to an internal combustion engine according to claim 4 wherein said step of correcting the basic fuel injection includes the steps of:

calculating a lean correction coefficient FLEAN for lean control mode and a feedback correction coefficient FAF for feedback control mode, said lean correction coefficient FLEAN being determined to be less than 1.0 in the lean control mode and be 1.0 in the feedback control mode, said feedback correction coefficient FAF being determined in such a manner than when the air-fuel ratio signal represents the lean air-fuel ratio in the feedback control mode, the feedback correction coefficient FAF is greater than 1.0 and when the air-fuel ratio signal represents the rich air-fuel ratio in the feedback control mode, the feedback correction coefficient FAF is less than 1.0, and the feedback correction coefficient FAF is 1.0 is the lean control mode.

6. Apparatus for controlling the air-fuel ratio of an air-fuel mixture to be supplied to an internal combustion engine comprising:

(a) means for detecting and determining that the engine is operating under a first operational state wherein conditions exist where a cooling water temperature is greater than a predetermined cooling water temperature, an engine load is less than a predetermined engine load and a vehicle speed is greater than a first operational condition of a predetermined vehicle speed;

(b) means for detecting said vehicle speed and determining if an additional first operational condition exists wherein said vehicle speed is less than a second predetermined vehicle speed wherein said second predetermined vehicle speed is greater than said first predetermined vehicle speed;

(c) means for detecting an engine acceleration and determining if a second additional operational condition exists wherein an acceleration of the engine is commencing; and (d) means for determining said air-fuel ratio such that when at least said first operational state exists, the air-fuel ratio is adjusted to the lean side of stoichiometric, and if both first and second additional operational conditions exist, the air-fuel ratio is adjusted towards substantially stoichiometric.

7. Apparatus for controlling the air-fuel ratio of an air-fuel mixture according to claim 6 wherein said means for detecting an engine acceleration includes means for detecting an amplitude of an absolute intake pressure of an intake passage downstream of a throttle valve, means for calculating a variation of the absolute intake pressure between successive detected absolute intake pressures, and means for comparing said variation with a reference value to determine whether said second additional operational condition exists wherein an acceleration of the engine is commencing.

8. Apparatus for controlling the air-fuel ratio of an air-fuel mixture to be supplied to an internal combustion engine comprising:

(a) means for detecting and determining that the engine is operating under a first operational state wherein conditions exist where a cooling water temperature is greater than a predetermined cooling water temperature, an engine load is less than a predetermined engine load and a vehicle speed is greater than a first operational condition of a predetermined vehicle speed;

(b) means for detecting said vehicle speed and determining if an additional first operational condition exists wherein said vehicle speed is less than a second predetermined vehicle speed wherein said second predetermined vehicle speed is greater than said first predetermined vehicle speed;

(c) means for measuring a time period starting from a time at which a fully closed throttle valve is opened;

(d) means for comparing the measured time period with a predetermined time period to determine whether the predetermined time period has lapsed; and (e) means for determining said air-fuel ratio such that when at least said first operational state exists, the air-fuel ratio is adjusted to the lean side of stoichiometric, and that if it is detected that the predetermined period of time has not lapsed and said additional first operational condition exists while the first operational state exists, the air-fuel ratio is adjusted towards substantially stoichiometric.

9. Apparatus for controlling the air-fuel ratio of an air-fuel mixture to be supplied to an internal combustion engine according to claim 8 further comprising:

means for detecting a concentration of a predetermined component of an exhaust gas to generate an air-fuel ratio signal, wherein said engine is provided with a fuel injector and said means for determining the air-fuel ratio includes:

means for calculating a basic fuel injection time corresponding to a fuel injection rate of said fuel injector in accordance with an engine speed and the engine load;

means for correcting, depending on the engine operational state, the basic fuel injection time duration so that it becomes less than the basic fuel injection time duration, thereby attaining a lean air-fuel ratio leaner than the stoichiometric air-fuel ratio and means responsive to the result of the correction for feedback controlling the air-fuel ratio to be substantially at the stoichiometric air-fuel ratio.

10. Apparatus for controlling the air-fuel ratio of an air-fuel mixture to be supplied to an internal combustion engine according to claim 9 wherein said means for correcting the basic fuel injection includes:

means for calculating a lean correction coefficient FLEAN for lean control mode and a feedback correction coefficient FAF for feedback control mode, said lean correction coefficient FLEAN being determined to be less than 1.0 in the lean control mode and be 1.0 in the feedback control mode, said feedback correction coefficient FAF being determined in such a manner that when the air-fuel ratio signal represents the lean air-fuel ratio in the feedback control mode, the feedback correction coefficient FAF is greater than 1.0 and when the air-fuel ratio signal represents the rich air-fuel ratio in the feedback control mode, the feedback correction coefficient FAF is less than 1.0, and the feedback correction coefficient FAF is 1.0 is the lean control mode.

* * * * *